US005695848A

United States Patent [19]

Wilkins et al.

[11] Patent Number: 5,695,848

[45] Date of Patent: Dec. 9, 1997

[54] PANEL FORMED FROM MOLDED FIBERGLASS STRANDS

[75] Inventors: Rodney R. Wilkins, Granville, Ohio; Carl J. Weaver, Waco, Tex.; Donald E. Dickson, Junction City; Jack E. Compston, New Lexington, both of Ohio

[73] Assignee: Nicofibers, Inc., Shawnee, Ohio

[21] Appl. No.: 560,391

[22] Filed: Nov. 17, 1995

Related U.S. Application Data

[63] Continuation-in-part of Ser. No. 361,187, Dec. 21, 1994, Pat. No. 5,639,411.

[51] Int. Cl.[6] ..... B32B 3/10

[52] U.S. Cl. ..... 428/131; 428/193; 428/195; 428/198; 428/219; 428/220; 428/304.4; 428/480; 442/331; 442/391

[58] Field of Search ..... 428/131, 195, 428/157, 158, 171, 198, 193, 219, 220, 307.3, 480; 442/331, 391

[56] References Cited

U.S. PATENT DOCUMENTS

| | | | |
|---|---|---|---|
| 2,546,230 | 3/1951 | Modigliani | 154/92 |
| 2,609,320 | 9/1952 | Modigliani | 154/90 |
| 2,644,780 | 7/1953 | Simkins et al. | 154/92 |
| 2,964,439 | 12/1960 | Modigliani | 154/90 |
| 2,984,286 | 5/1961 | Copenhefer | 154/1 |
| 3,054,714 | 9/1962 | Johnston | 156/212 |
| 3,072,513 | 1/1963 | Schlarb | 154/54 |
| 3,092,533 | 6/1963 | Beckner | 156/167 |
| 3,230,287 | 1/1966 | Caron et al. | 264/120 |
| 3,583,030 | 6/1971 | Terry et al. | 18/4 |
| 4,038,359 | 7/1977 | Beranek, Jr. et al. | 264/160 |

*Primary Examiner*—Patrick Ryan
*Assistant Examiner*—J. M. Gray
*Attorney, Agent, or Firm*—Kremblas, Foster, Millard & Pollick; Sidney W. Milliard

[57] ABSTRACT

A panel is formed from an expanded mat of fiberglass strands, a thermosetting resin binder is incorporated with these strands. When the panel is formed, it has a relief between the edges of the panel and the recessed portion of the panel. The panel is retained in its molded position by the setting of the thermosetting resin binder.

13 Claims, 6 Drawing Sheets

PANEL FORMED FROM MOLDED FIBERGLASS STRANDS

RELATED APPLICATIONS

This is a continuation-in-part of application Ser. No. 08/361,187 filed Dec. 21, 1994, now U.S. Pat. No. 5,639,411.

FIELD OF THE INVENTION

This invention relates to expanding or stretching condensed mats of fiberglass and deforming the same to provide a formed panel of fiberglass.

BACKGROUND OF THE INVENTION

Technology for making a condensed mat of fiberglass strands is well known in the art and the system is described fairly well in several patents to Modigliani, U.S. Pat. Nos. 2,546,230; 2,609,320 and 2,964,439. Each of the patents describes a melting furnace feeding molten glass to spinning orifices which discharge fine glass fibers, which in turn are wrapped circumferentially around a spinning drum. During the deposition of the fibers on the rotating drum, a thermosetting resin is applied to the surface to hold the fibers at their overlapping junctions between layers.

Ordinarily the furnace and spinning orifices move longitudinally along the rotating drum during the assembly process. The translation of the furnace with respect to the drum is relatively slow and the drum is rotating relatively fast to provide a build-up of a plurality of layers of the fiberglass.

After a suitable thickness of fibers has been created, the condensed mat is severed from the drum by a cut across the mat parallel with the axis of the drum. Thereafter, the condensed mat is deposited on a conveyor belt which moves longitudinally at a very slow pace. The severed condensed mat is generally rectangular in shape and the fibers are continuous for the most part and extend completely across the width of the mat in a direction generally perpendicular to the direction of movement of the conveyor belt.

At the exit end of the conveyor belt, a retarding roller presses the condensed mat against the conveyor belt which is supported by an oppositely rotating support roller. The leading end of the condensed mat beyond the retarding roller is stretched or expanded longitudinally up to 500 or 600 times the original length of the condensed mat. The expanding is a continuing process with the leading end being pulled longitudinally while the confining-retarding roller minimizes the forward movement of the remaining condensed mat.

As the mat is expanded longitudinally, it also fluffs vertically to a consistency somewhat like cotton candy and the transversely extending fibers are pulled longitudinally tending to rotate and reorient the fibers such that they assume a 45° or greater angle with respect to the longitudinal direction as the mat is stretched and necks down to a smaller width.

After the majority of the expanding takes place, the fluffed, expanded mat is rolled to confine it to a thinner mat and it is heated by radiant heaters to partially set the thermosetting resin incorporated during the deposition of the fibers on the drum. Thereafter, the stretched fiberglass mat is wound on a drum where it may be transported to other locations for use in various embodiments such as heat, thermal and sound insulation and filters as an example.

A patent to Simkins et al., U.S. Pat. No. 2,644,780, defines a similar process which includes stacking a plurality of mats to have a thicker resulting mat for use.

A patent to Copenhefer, U.S. Pat. No. 2,984,286, discloses a glass filament feeding technique which purports to improve the quality of the mat deposited on the drum.

A patent to Schlarb, U.S. Pat. No. 3,072,513, discloses another technique for treating the fibrous mat during its expansion to improve its qualities.

A patent to Beckner, U.S. Pat. No. 3,092,533, discloses an apparatus and process for controlling the thickness of the expanded mat.

What none of these patents disclose is a way of making a continuous series of fiberglass panels from the expanded mat with the mat having a substantial pattern and transverse relief as molded.

SUMMARY OF THE INVENTION

This invention provides a technique for stretching or expanding and molding mats of fiberglass which is not disclosed in the aforementioned patents and not known in the industry.

This invention intends to provide a preform or panel of fiberglass strands where the strands extend completely across the width and length of the preform. Molded preform elements formed from continuous strands are considerably stronger in tension and in maintaining their molded shape than are chopped fibers of the same glass strands. Insofar as is known in the industry at this time, there is no convenient way for a continuous molding process incorporating continuous strands from an expanded mat of fibers originating as a condensed mat as described in the Modigliani patents identified above.

Apparatus of this invention for expanding the condensed mat is conventional with respect to the hold-back features of the condensed mat and the means for maintaining the desired width of the expanded mat. What is different in this invention is the way of expanding the mat longitudinally. A first embodiment includes a gripping mechanism on the edges of each of a plurality of female molds mounted on a framework. In this invention, expansion will be in the range 100–600 times.

The framework is located downstream of the hold-back rollers and mounted to rotate about an axis which is generally perpendicular to the direction of longitudinal expansion of the condensed mat of fibers. In this specific design, the framework is square, one female mold is mounted on each face of the framework and extends between corners. The expanded fibers are advanced and elongated by a gripper on the leading edge of each of the female molds. That is, the framework rotates in a direction to pull the fibrous mat longitudinally away from the retarding rolls engaging the condensed mat. On the leading edge of each of the female molds is a grip which engages the mat and pulls it longitudinally as the frame rotates. The preferred gripping mechanism is a plurality of pins, pegs or prongs which penetrate the fiberglass mat in a direction generally perpendicular to the longitudinal direction of expansion.

Corresponding pins, pegs or prongs are provided in the trailing edge of each female mold and along the side edges extending from the leading edge to the trailing edge. Thereby, the gripping prongs prevent the fibrous mat from being dragged inwardly when a male section of the mold compresses the expanded mat to deform it inwardly to the desired patterned structure. Spacer blocks may be provided along the edges of the molds to prevent excessive compression of the fiberglass mat when it is formed. It is desired that the thickness of the mat be maintained in a range 1/16 to 1 inch thick in its compressed, formed condition. The relief achieved by the molds may exceed about fourteen inches in a transverse direction.

Incorporated within the elongated fiberglass mat is a thermosetting resin which cures or sets at a temperature in the range 300° F. to 750° F. and it is desirable to set the resin with the fibers in the formed condition. Thus it will retain its formed shape after it is removed from between the male and female molds. Thermoplastic resin may be used under certain conditions.

In the first preferred embodiment, the heat for setting the thermosetting resin is provided through duct work from a heater to deliver hot air through porous male and female molds and through the porous fiberglass mat for a period of time in the range of about 1 to 25 and preferably 20 seconds. Thereafter, the male mold is retracted, the framework rotated or indexed forward as the next section of the expanded mat is pulled forward over the next female mold. The molded fiberglass preform is pulled from the mold manually, mechanically or preferably by the fibers extending from the prior molded fiberglass preform which is pulled transversely from the framework by a conveyor belt leading to a blade for severing the fibers between molded preforms.

The result is a patterned panel formed from a flat panel to have a relief of up to fourteen inches.

In a second preferred embodiment, the expanded mat is delivered to a forming station where both the male and female molds reciprocate vertically to deform the mat to the desired shape and then retract vertically to allow the continuous mat to be indexed forward by a conveyor belt properly coordinated with the reciprocating molds.

Downstream of the male and female mold forming station is a vertically reciprocating severing device which cuts the preform to shape. It is anticipated that the cutting station will sever the desired preform completely around its periphery leaving a surrounding waste portion of the mat to pull the materials forward in the next indexing operation.

Objects of the invention not understood from the above description will be fully appreciated upon a review of the drawings and the description of the preferred embodiments which follow.

DETAILED DESCRIPTION OF THE PREFERRED EMBODIMENTS

Figure 1:
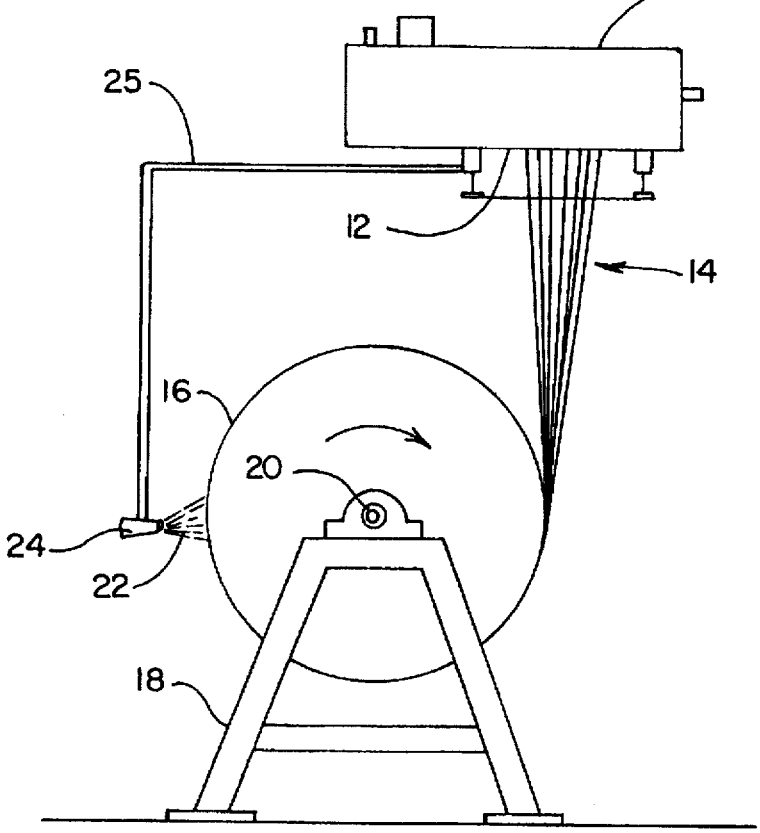
FIG. 1 is a side elevational view of apparatus for forming a condensed mat of glass fibers.

FIG. 1 illustrates schematically the formation of a condensed mat of glass fibers or strands in a partially conventional forming operation generally described in the Modigliani patents described above and in a manner well known in the industry. Glass is delivered in proper condition to a furnace 10 where it is melted and spun from a suitable patterned orifice plate 12 in the form of a plurality of endless glass fibers 14, preferably having a diameter of about 28 microns, which are deposited on a rotating drum 16 supported on a frame 18. In conventional fashion, the furnace and/or orifice plate move back and forth across the surface of the rotating drum which may be several feet in length until a suitable thickness Of layers of fiberglass are deposited on the drum 16. Then the condensed mat of glass fibers is cut from the drum by severing the fibers longitudinally along the drum generally parallel with the axis of rotation 20 of the drum. Preferably the mat will have a thickness of about ¼ inch and a density of about 70 lbs/ft$^3$.

During the process for depositing the layers of fiberglass on the drum 16, a thermosetting resin 22 is sprayed from a nozzle 24 in well known fashion. The spraying operation may be by way of hand operation or it may be mechanical. Some prior art procedures describe applying the resin binder 22 by brush or roller instead of being sprayed from a nozzle. The way the resin is applied in this invention is by a mechanically-computer controlled spray apparatus which is mechanically connected at 25 to move longitudinally with the furnace and orifice plate 12.

In this invention it is desirable that the resin be thermosetting in the temperature range of from about 300°–750° F., preferably about 550°–650° F. and most preferably about 600° F. which will cure in about 1–25 seconds and most preferably about 20 seconds. A suitable resin for this purpose is available commercially as a mixture which is water soluble and may be primarily an acrylic resin, phenol formaldehyde, urea-formaldehyde, polyvinyl alcohols, latex and the like. The preferred polyester resin mixture is purchased from Ashland Chemical Company with the trade designation CARGIL 72-7207 and may be modified to generally have the formula:

65–75% polyester
12–18% isopropyl alcohol
0.8–1.2% trimethyoxysilan- (trademark MEMO from Cook Composites)
0.4–0.8% triethylammonium catalyst (trademark STYPOL 044-0235)
0.4–0.6% trimethylamine
10–15% melamine (trademark RESIMENE 745)

Another recipe for a suitable resin binder which has been found to be effective for securing glass fibers together in the environment of this invention is:

65–85% polyester
8–20% xylene
4–12% D.A.P. (diallylphthalatemonomeri
0–1.0% silane (trimethyoxysilan)
0–2.0% acetone
0–1.0% cao-3 (2, 6-di-tert-butyl-p-cersol)
0–1.0% hydriquinone
0–1.0% B.P.O. (benzoyl peroxide)

The sequence for mixing the ingredients is well known in the industry and need not be described here.

It should be noted that the temperature of the fibers 14 as they are deposited on drum 16 is below the thermosetting temperature of the suitable resin specified for this invention. The resin is sprayed by air atomization to provide a resin content of about 10% by weight of fibers, plus or minus 5%.

Figure 3:
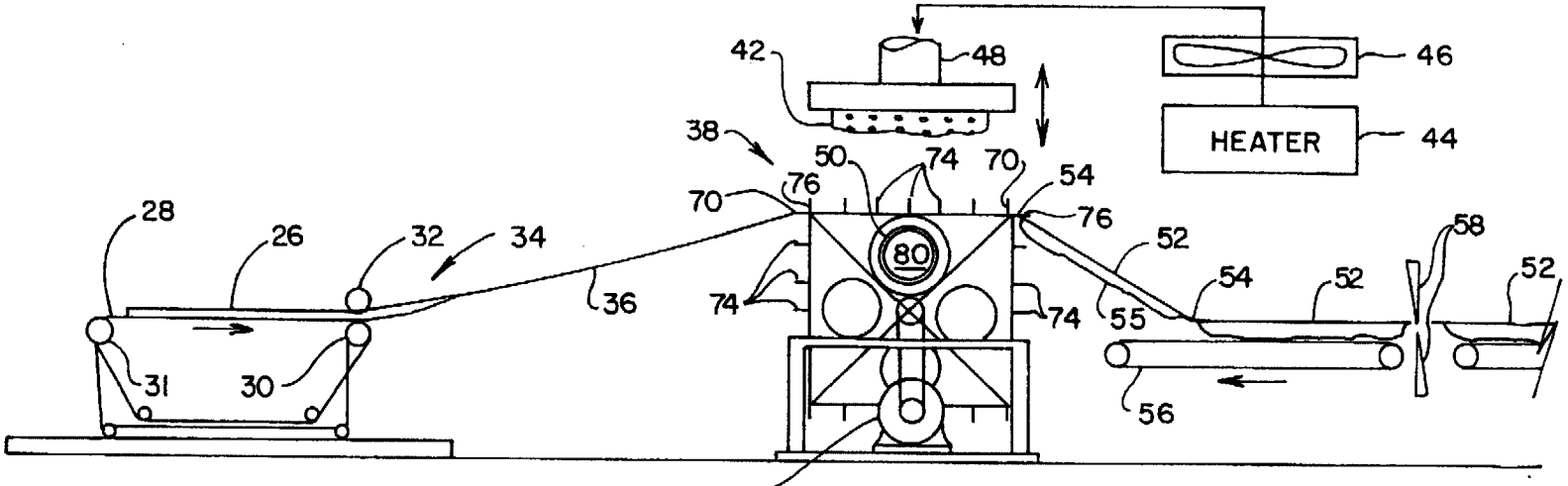
FIG. 3 is a side elevational view of the apparatus of FIG. 2 and including a heater and a blower shown schematically.
Figure 2:
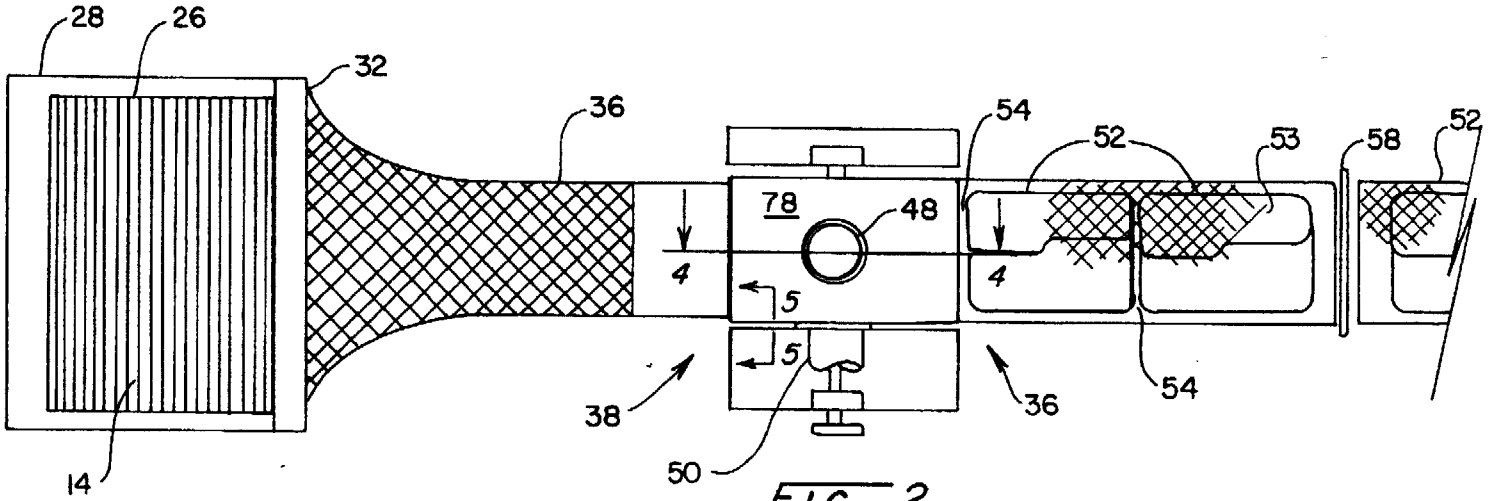
FIG. 2 is a top plan view of the apparatus of this invention for molding a preform from an expanded mat of fiberglass strands expanded from a condensed mat severed from the drum illustrated in FIG. 1, the expanded mat being drawn longitudinally by a rotating frame and formed into preforms by reciprocating mold surfaces.

Looking to FIGS. 2 and 3, the condensed mat 26 stripped from the drum 16 is generally rectangular in shape and is deposited on a conveyor 28 supported on a plurality of rollers 30, 31 which allows the condensed mat to be fed in a direction generally illustrated as from left to right and the speed of advance of the condensed mat 26 is controlled by a retarding roller 32 which pinches the condensed mat and conveyor 28 between it and supporting roller 30. Together rollers 30 and 32 combine to serve as holdback rollers in the mat expansion process.

In conventional fashion, the fibers 14 in the condensed mat 26 extend essentially perpendicular to the longitudinal direction of movement of conveyor 28. There is a slight acute angle between layers of fibers 14, but for purposes of the inventive concept they are almost parallel with each other.

In conventional fashion, when the expanding mat exits the pinch area between rollers 30 and 32 the mat fluffs vertically as at 34 in FIG. 3, necks down to a narrower width as illustrated in FIG. 2, and the expansion of up to 100–600 times (or more) the original longitudinal length of condensed mat 26 tends to reorient the fibers to an angle of 45°, 60° or even greater degree between layers, depending on the magnitude of the expansion, somewhat as is illustrated schematically in FIG. 2. Notwithstanding the expansion and the reorientation of the fibers, the strands extend generally completely across the full width of the expanded mat. The reason this is desirable for the subsequent molding procedure is that continuous or essentially completely continuous strands provide greater strength in tension, structural durability and retention of shape than chopped glass fibers which may be molded to the same shape as will be described subsequently. Accordingly, the continuous strand mat of this invention is far superior to the panels formed of chopped strands of fiberglass.

A mechanism for maintaining a suitable width for the expanded mat 36 is conventional and need not be described herein. Preferably the degree of expansion and subsequent formation will provide a panel with a weight of about 0.25–4 oz./ft$^2$.

Figure 6:
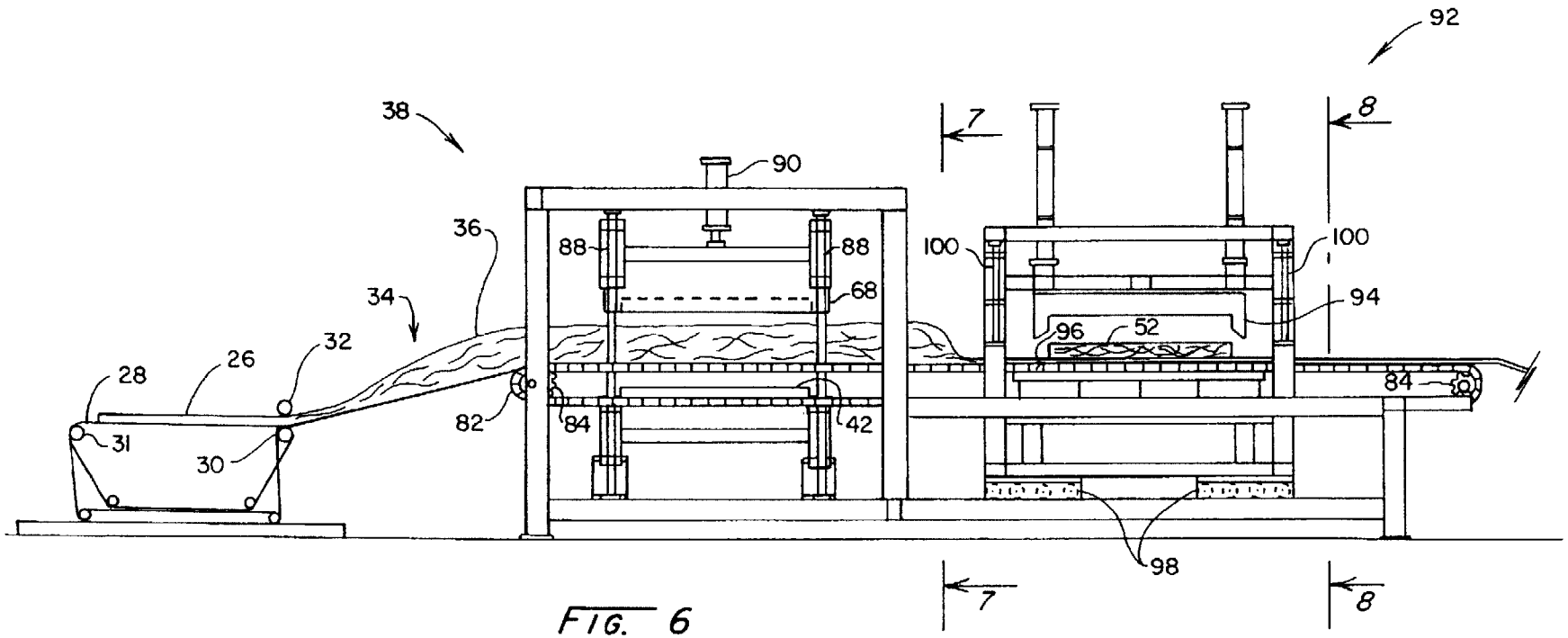
FIG. 6 is a schematic side elevational view of a second embodiment with two work stations downstream of the expanding process.

While the drawings, particularly FIGS. 3 and 6, show the mat 36 being delivered directly from retarding rolls 30, 32 to the deforming work station 38, it is within the inventive concept to (1) compress the mat 36 to a suitable thickness in conventional fashion, (2) roll the expanded mat on a spool, (3) convey the rolled mat to a work site and (4) feed work station 38 from the roll.

Figure 4:
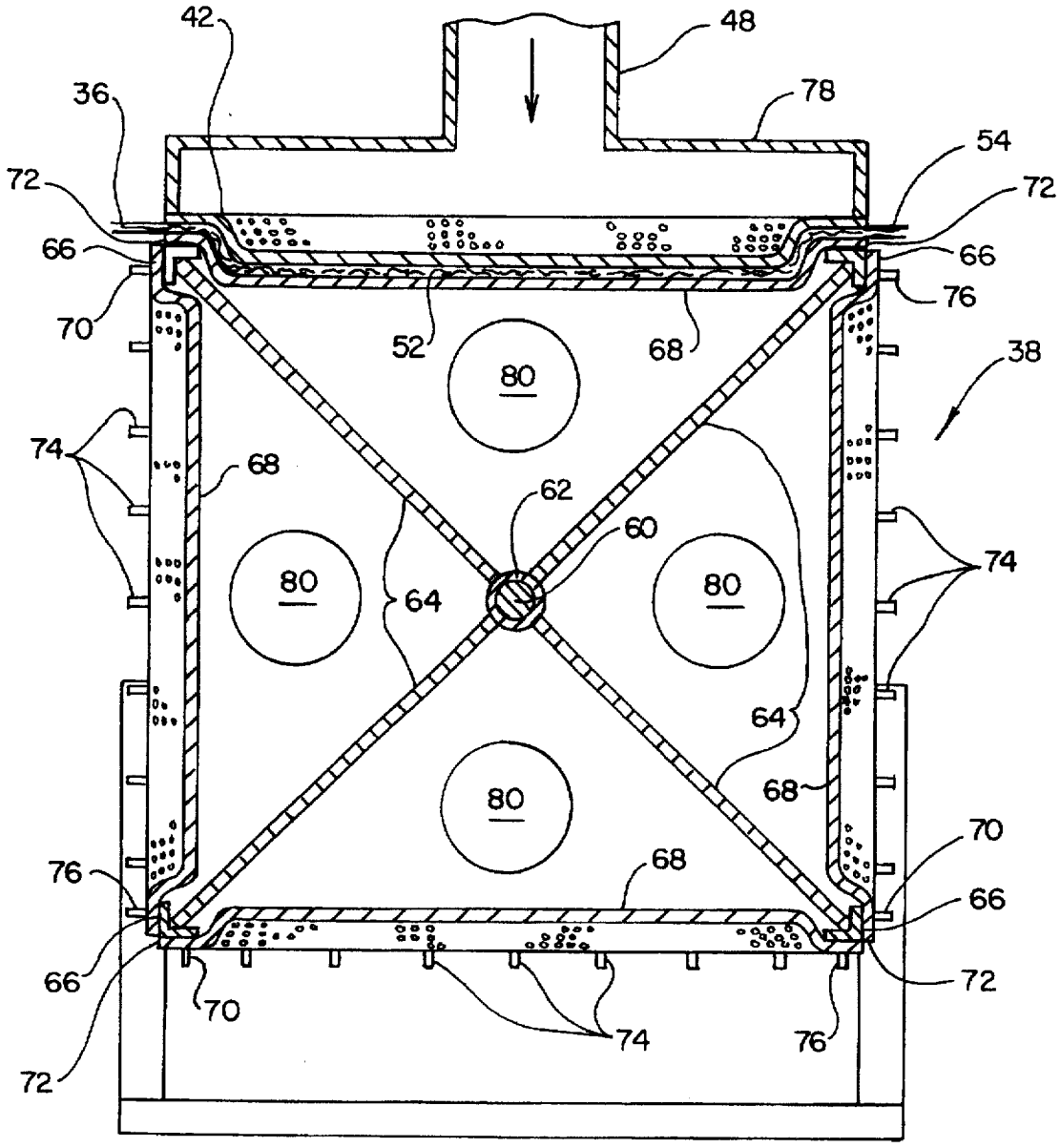
FIG. 4 is a fragmentary sectional view taken along line 4–4 of FIG. 2.

A suitable distance downstream from retarding rollers 30, 32, is a work station or framework 38 which is best seen in FIG. 4 and will be described in detail subsequently. Expanded mat 36 is drawn longitudinally by a gripper on the leading end of a female mold 68. One female mold 68 is mounted on each face of the square framework illustrated in FIG. 3. It is indexed forward in clockwise direction by a programmed motor Each female mold mounted in the framework is rotated to a location suitable for mating with a male mold 42 which is mounted to reciprocate into and out of mating relationship with one of the female molds in the framework 38.

Male mold 42 is connected in fluid relationship with a heater 44 which heats air to a temperature suitable for curing thermosetting resin incorporated in the expanded mat 36. Hot air from heater 44 is driven by blower 46 through a duct work 48 to male mold 42. The hot air passes through the perforated surface of male mold 42, through the glass fiber mat 36, through a similarly perforated female mold 68 and is discharged from the framework through one of a plurality of ports 80 leading to a duct 50.

Preforms 52 resulting from formation of expanded mat 38 between male 42 and female 68 molds and thermosetting heat from the heater 44 are extracted from the molds when the male mold 42 is retracted and the motor 40 indexes or rotates the framework 38 forward in a clockwise direction. Each preform or formed panel 52 is connected with the next prior preform by connecting fiberglass strands which serve as a bridge 54 to assist the leading preform in pulling the trailing preform from the female mold with an assist from a conveyor belt 56. After formation, each preform 52 includes a recessed face 53 and a projecting face 55.

It will be understood that the conveyor belt 56 is an optional feature. The preforms 52 may be extracted from the female mold by any mechanism desirable, but in this, the first preferred embodiment, the bridging strands 54 serve to drag the trailing preform along until it arrives at a severing blade 58.

Figure 5:
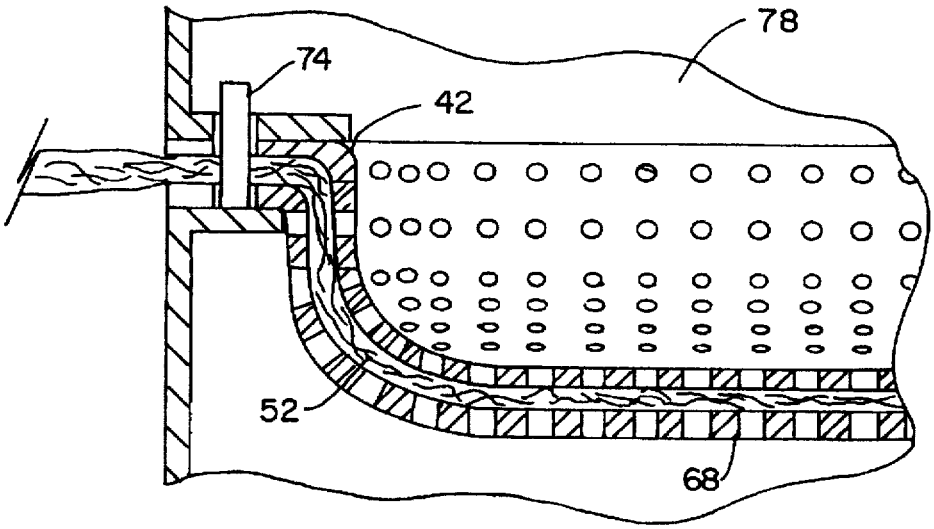
FIG. 5 is a fragmentary sectional view of closed molds according to this invention taken along line 5–5 of FIG. 2.

Looking now to FIGS. 4 and 5, the framework 38 is mounted to rotate about an axis 60 of an axle 62 having spokes 64 extending radially therefrom. Spokes 64 support transversely extending angle irons 66 which in turn support the four porous female molds 68.

It should be emphasized that in this preferred embodiment the female molds are mounted on the four sides of the framework 38, but it should be equally clear that the female molds could be replaced by the male molds 42. This operation lends itself more favorably to the male/female mold relationship illustrated since an upwardly projecting male mold might make it more difficult for the gripping prongs 70 on the leading edge 72 of the female molds which penetrate the leading end of the expanded mat 36 and expand it and elongate it to pull it longitudinally forward away from retarding rollers 30, 32. Should the male mold 42 be mounted in the framework 38, the upwardly projecting portion might tend to push the leading edge of the penetrated fibrous mat 36 away from the mold surface and cause it to disengage from gripper 70. This result is easily overcome by elongating prongs 70, 74 and 76.

In this particular operation, the female mold 68 is preferably mounted on the framework as shown.

It will further be observed that prongs 74 projecting upwardly from the side edges of each female mold 68 and similar prongs 76 projecting outwardly from the trailing end of each female mold cooperate with prongs 70 during the molding process to hold the edges of the fiberglass against being dragged into the central part of the mold when the male mold presses and forms the fiberglass into the female mold.

In operation, the condensed mat 26 is expanded in conventional fashion and directed to a framework 38 where it is engaged by a gripper mechanism 70 at the leading end of each female mold 68. When the framework 38 is rotated to a suitable position for reciprocally engaging a male mold 42 in mating fashion, it stops. Male mold 42 descends as illustrated in FIG. 3 to a position shown in FIGS. 4 and 5. This compresses and forms the expanded mat 36 to the shape of a preform 52 of a specified thickness of 1/16 to 1 inch thick and a degree of relief from a horizontal surface to the greatest depression or formation of possibly over fourteen inches. Greater deformation tends to cause separation and thinning of the preform 52 at unspecified locations within the preform 52 and in particular, where the prongs or gripping devices engage the preform.

After the male mold descends to the degree desired, its downward movement is minimized by spacer blocks (not shown) to insure the proper thickness of the preform, a blower 46 is activated to blow hot air from heater 44 through duct work 48 at a suitable temperature to a plenum chamber 78 and the hot air is delivered to the plenum chamber 78 for a period of 1–25 seconds which is adequate to cure the thermosetting resin 22 incorporated within the preform 52. The hot air passes into the plenum chamber, through the porous male mold 42, through the fibrous material of the preform 52 and out of the female mold 68 between the spokes 64 where it is discharged transversely through a port or opening 80.

After the preform 52 is cured such that it will retain its shape, male mold 42 is retracted and the framework 38 is rotated or indexed forward by motor 40. Bridge strands 54 extending between preforms pull the just-formed preform 52 from the female mold 68. The leading edge prongs 70 on the next advancing female mold grip, pull and further expand the expanded mat 36 into position for the next molding procedure.

The extracted preforms 52 are deposited automatically on conveyor belt 56 and delivered to cutting blades 58 where each preform is severed from the other and then may be stacked in nested fashion (not shown) for shipment to another location for incorporation into a finished product. For example, the particular preform illustrated in FIG. 2 may be trimmed and incorporated as a part of an automobile door. It should be noted that preform 52 may have a generally rectangular periphery or a non-rectangular periphery as needed. Blades 58 may be structured to perform a more elaborate trimming function if desired.

FIGS. 6–9 illustrate a second preferred embodiment and numerals in FIGS. 6–9 correspond to numerals in FIGS. 1–5 where the same structural features are identified.

FIG. 6 illustrates a second preferred embodiment wherein the work station 38 includes a female mold 68 in combination with a male mold 42 and both reciprocate vertically to deform the expanded mat 36 to the desired shape. In the illustrated embodiment of FIG. 6 the expanded mat 36 is shown fluffed vertically and it may or may not be in that condition. It could be fed from a roll already compressed to a one or two inch thickness as mentioned earlier.

In any case, the expanded mat 36 is fed to work station 38 on a conveyor belt which includes side chains 82 driven by sprockets 84 which are connected to some drive motor not shown. Transversely extending slats 86 extend across the space between parallel chain drives 82. It will be observed in FIG. 9 that slats 86 are longitudinally spaced apart a distance of about the length of the preform 52 which is to be compressed and formed between molds 42, 68. That is why both molds must reciprocate vertically so that they will be out of the way of the horizontally moving slats 86 after each forming operation is accomplished.

While the structure of the heater, fan, and duct work are not shown in FIGS. 6–9 in the same way as they are shown in FIGS. 1–5, the same structure is incorporated and both molds shown in the second embodiment of FIGS. 6–9 are also perforated to allow the hot air flow from heater 44 to cure the thermosetting resin incorporated in expanded mat 36.

Figure 7:
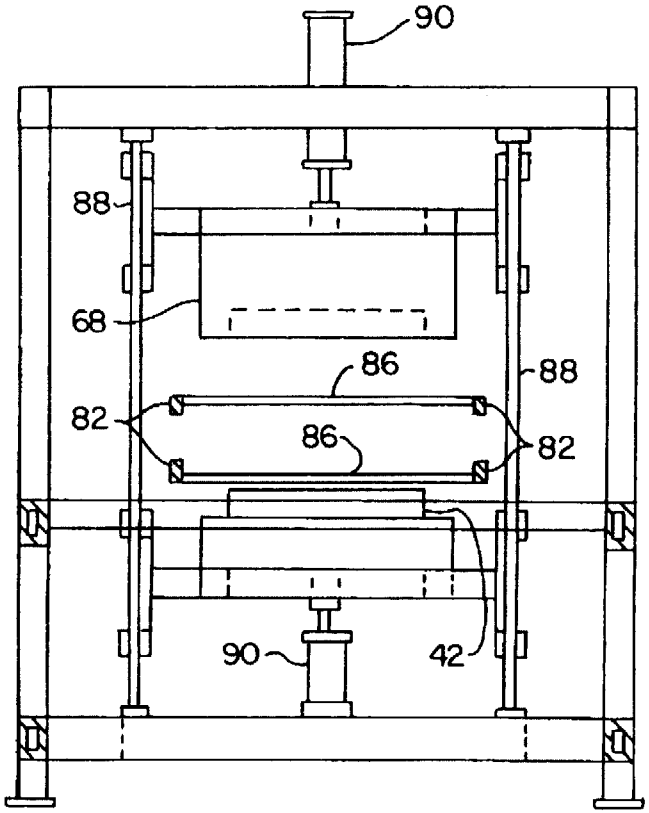
FIG. 7 is an end elevational view taken along line 7–7 of FIG. 6.
Figure 9:
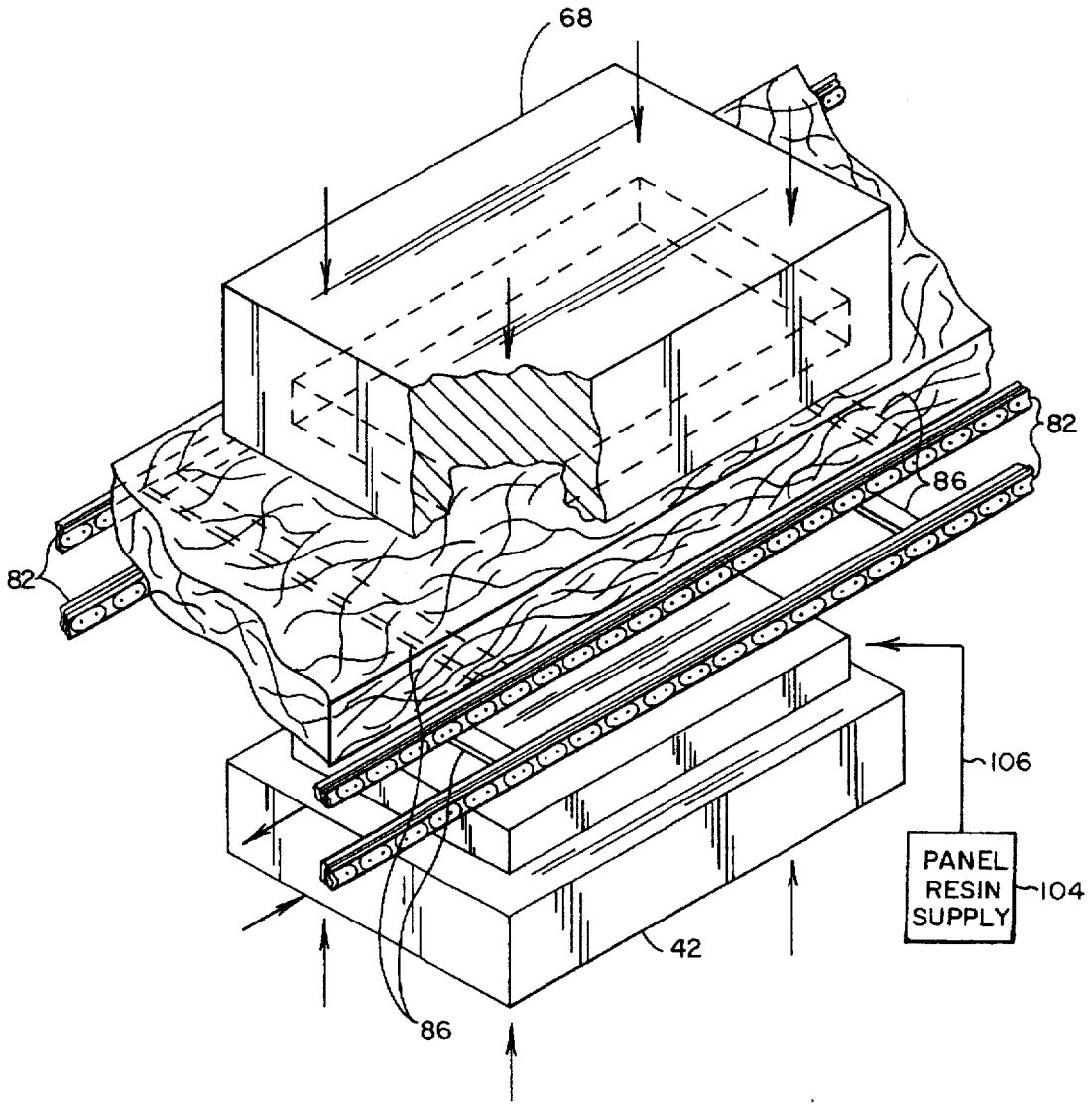
FIG. 9 is a perspective view of the male-female molding elements oriented to deform an expanded mat conveyed by a conveyor belt according to this invention.

As best seen in FIG. 7, the molds ride upwardly and downwardly on guide bars 88 which are configured to support the molds outside the space covered by side chains 82 and slats 86. Pistons 90 are mechanically, pneumatically, or electrically coordinated to reciprocate in a desired movement pattern consistent with the structure of the forming operation.

It will be observed that the next work station 92 downstream of work station 38 comprises a framework similar to work station 38 where a cutting blade 94 cuts the preform 52 to the desired peripheral shape. The vertically downwardly moving cutting element 94 descends and cuts through the fiberglass mat above a polypropylene pad 96 which rises to meet the cutting blade Note that work station 92 is mounted on wheels or rollers 98 to allow its longitudinal movement with respect to work station 38. This allows different molds 42, 68 of different sizes to be mounted in work station 38 and work station 92 can be adjusted a specific distance away. Thereby, one or more preforms may be formed and conveyed on the chains 82 and slats 86 to the second work station 92. It will be clear that a given number of preforms 52 will be supported between work station 38 and work station 92 because the work station 92 cannot be randomly spaced if it is to provide a cutting operation with a proper preform shape.

In this preferred embodiment the expanded mat 36 extends transversely beyond the edges of chains 82 to provide support and each slat has a width of about two inches. Furthermore, the space between each preform 52 in the continuously extending mat 36 is about four to six inches apart so that a relatively flat edge of the preform 52 extends beyond the edges of the chains 82 and the space between preforms bridges across the two inch wide slat.

While it is described as a cutting operation, in fact the physical characteristics of the fiberglass extending completely across the preform is such that when the die or cutting element 94 descends to the polypropylene mat 96, the glass fibers fracture rather than being cut by the die 94.

Figure 8:
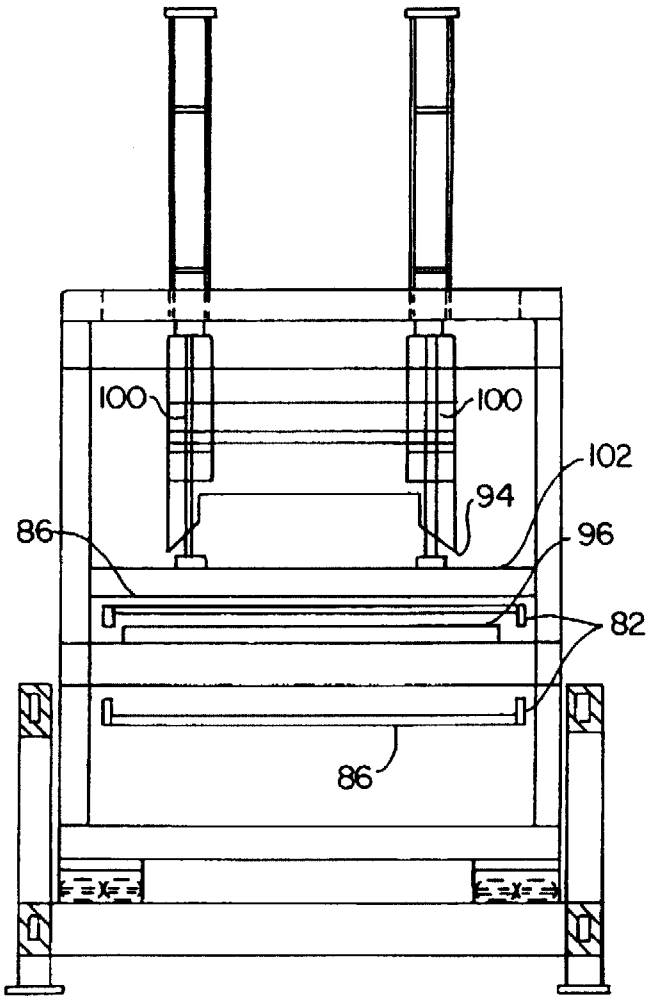
FIG. 8 is an end elevational view taken along line 8–8 of FIG. 6.

Guide bars 100 are supported on cross beams 102 which move vertically as far down as is illustrated in FIG. 8 and obviously must reciprocate vertically to allow the chain drive to index forward with the next preform for cutting.

While it is not illustrated in FIGS. 6–9, the chains and slats may have vertically extending prongs to serve the same function as prongs 70, 74 and 76 in the first embodiment.

In certain circumstances a thermoplastic resin may be used to maintain the fibers in place. Where thermoplastic resin is used the porous molds will first be heated to soften the resin and then cooled to set the resin. Under some situations ultraviolet rays may be used to set the resin without departing from the inventive concept.

Indeed, it is within the inventive concept to provide the expanded mat in flat, unformed, condition directly to the plastic molding operation. In such a process the expanded mat is drawn to a work station between male and female molds. The molds move together to deform the mat to a desired shape. Then a suitable panel forming resin 104 is injected or otherwise supplied 106 to the cavity between the molds to completely encompass the deformed mat. Cross-linking of the polymer molecules of the panel forming resin may be exothermic and the heat generated in its solidification sets the thermosetting resin 22. Where this embodiment is used, the intermediate step of making the preform is eliminated.

Having thus described the invention in its preferred embodiment, modifications to the structure and the procedural steps will be obvious to those having ordinary skill in the art. Accordingly, it is not intended that the invention be limited by the description of the preferred embodiment nor the drawings illustrating the same. Rather, it is intended that the invention be limited only by the scope of the appended claims.

We claim:

1. A panel formed from strands of fiberglass, said panel including continuous aligned strands of glass in a plurality of layers, at least some of said strands extending completely across said panel, said panel including a periphery, a thickness, a recessed face, a projecting face, a leading edge, a trailing edge, and side edges; said panel being porous to allow air passage through one of said faces, into said panel and out through the other of said faces, said panel being formed from a flat panel into a patterned panel having a relief between each edge and said recessed face, and said panel being retained as a patterned panel by a thermosetting resin binder.

2. The formed panel of claim 1 wherein said formed panel has a rectangular periphery.

3. The formed panel of claim 2 wherein said formed panel has a weight of about 0.25 oz. to about 4 oz. per square foot.

4. The formed panel of claim 3 wherein said formed panel has a thickness in the range of about 1/16 to about 1 inch.

5. The formed panel of claim 1 wherein said formed panel has a non-rectangular periphery.

6. The formed panel of claim 1 wherein said formed panel has a weight of about 0.25 oz. to about 4 oz. per square foot.

7. The formed panel of claim 1 wherein said formed panel has a thickness in the range of about 1/16 to about 1 inch.

8. The formed panel of claim 1 wherein said relief is up to fourteen inches.

9. The formed panel of claim 1 wherein said thermosetting resin binder has a weight and said strands have a weight, the weight of said thermosetting resin binder being between about five and about fifteen percent of said weight of said strands.

10. The formed panel of claim 9 wherein said formed panel has a rectangular periphery.

11. The formed panel of claim 9 wherein said formed panel has a non-rectangular periphery.

12. The formed panel of claim 1, wherein said resin is a mixture comprised of between about 65% and about 75% polyester, between about 12% and about 18% isopropyl alcohol, between about 0.8% and about 1.2% trimethyoxysilan, between about 0.4% and about 0.8% triethylammonium catalyst, between about 0.4% and about 0.6% triethylamine, and between about 10% and about 15% melamine.

13. The formed panel of claim 1 wherein said resin is a mixture comprised of between about 65% and about 85% polyester, between about 8% and about 20% xylene, between about 4% and about 12% diallylphthalatemonomer, up to 1.0% silane (trimethyoxysilan), up to 2.0% acetone, up to 1.0% cao-3(2, 6-de-tert-butyl-p-cersol), and up to 1.0% benzoyl peroxide.

* * * * *